United States Patent [19]

Regan

[11] Patent Number: 4,466,146

[45] Date of Patent: Aug. 21, 1984

[54] PORTABLE BABY CHANGER

[76] Inventor: Patricia G. Regan, 25 Irving Dr., Woodbury, N.Y. 11796

[21] Appl. No.: 390,527

[22] Filed: Jun. 21, 1982

[51] Int. Cl.[3] ..... A47C 29/00

[52] U.S. Cl. ..... 5/98 B; 5/94; 5/99 A; 4/659; 4/572

[58] Field of Search ..... 5/60, 94, 98 B, 99 A, 5/118, 431, 462, 464; 248/212, 213, 213.2; 4/621, 622, 654, 659, 572–575

[56] References Cited

U.S. PATENT DOCUMENTS

| | | | |
|---|---|---|---|
| 1,261,951 | 4/1918 | MacGowan | 5/94 |
| 1,435,115 | 11/1922 | Gatling | 5/94 |
| 1,616,591 | 2/1927 | McGee | 5/94 |
| 1,658,944 | 2/1928 | Schaeffer | 4/572 |
| 1,950,709 | 3/1934 | Wells | 4/659 |
| 2,381,759 | 8/1945 | Lanese | 5/98 |
| 2,557,556 | 6/1951 | Morris | 5/94 |
| 3,644,947 | 2/1972 | Padera | 5/431 |

*Primary Examiner*—Alexander Grosz
*Assistant Examiner*—Michael F. Trettel
*Attorney, Agent, or Firm*—Michael I. Kroll

[57] ABSTRACT

A portable baby changer is provided and consists of a frame that engages a front lip of a sink, an adjustable hook strap that engages the frame and one faucet of the sink, a container that is supported by the frame and a pad placed within the container so that the baby can be put within the container and have its diaper changed.

1 Claim, 7 Drawing Figures

Figure 1
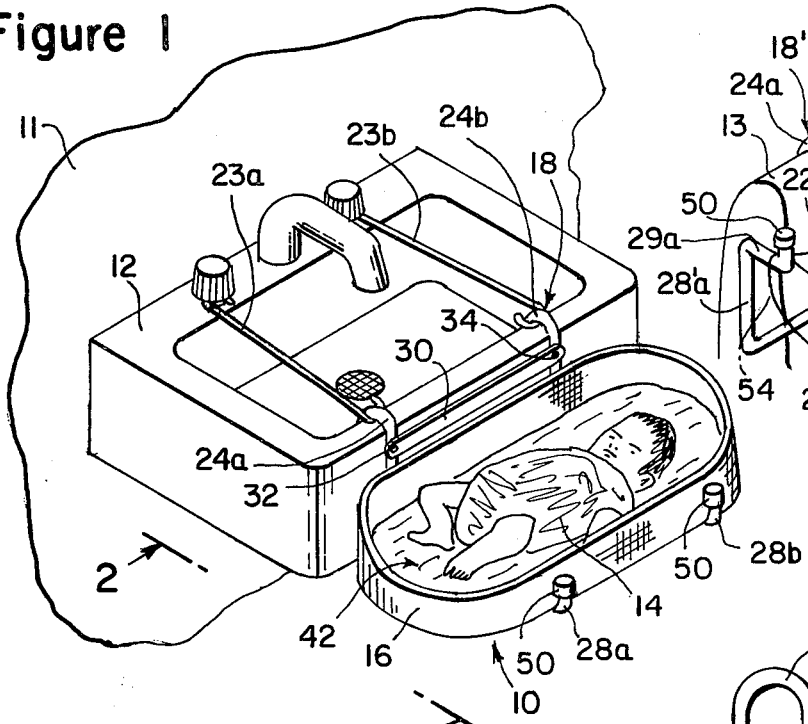
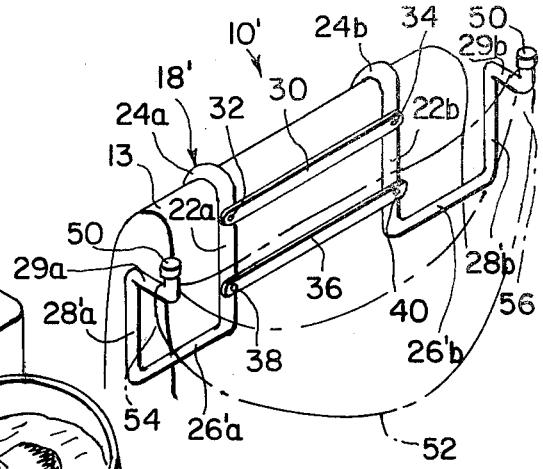
Figure 7
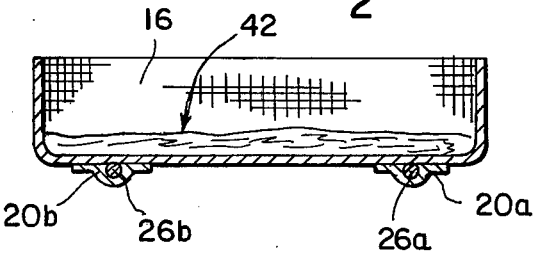
Figure 3
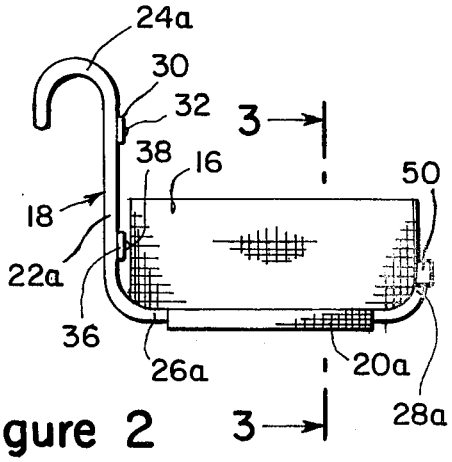
Figure 2
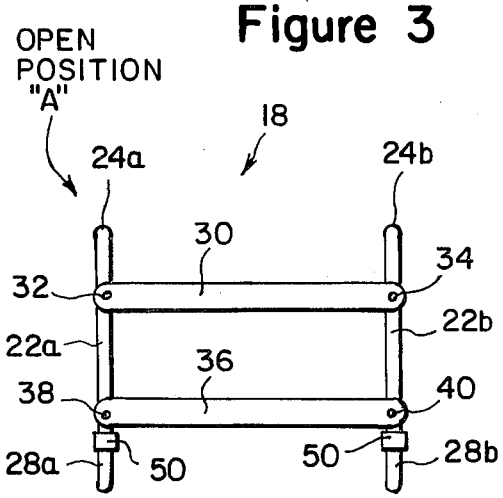
Figure 4
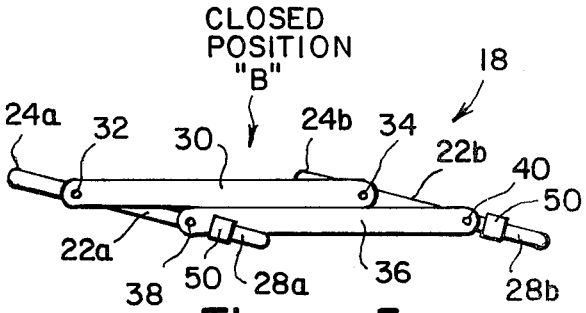
Figure 5
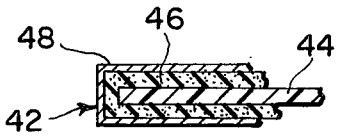
Figure 6

PORTABLE BABY CHANGER

BACKGROUND OF THE INVENTION

1. Field of Invention

The instant invention relates generally to changing baby diapers and more specifically it relates to a portable baby changer.

2. Description of the Prior Art

An infant or young child needs to have its diaper changed at least six times a day. If a baby is taken out of the house soiled and wet diapers must be changed in a car, at an amusement part, shopping mall, restaurant, beach, airport or a highway service station.

People are changing diapers on public lawns, benches, restroom floors, chairs or tables. Chairs can handle only very small children. Many change their babies on slanted car seats which can be difficult and uncomfortable to use. Others use a table on which other children have been cleaned or changed. This table is not sanitary and at times the table is not available at all.

SUMMARY OF THE INVENTION

The portable baby changer provides a safe sanitary, non-embarrassing convenient way to care for a child of diaper changing age while away from home.

It consists of a frame, an adjustable hook strap, a container and a pad within the container. The frame can engage the front of a sink or the back of a car seat. The container will hold the baby for diaper changing.

A principle object of the present invention is to provide a portable baby changer that is a portable place to change a baby's diaper.

Another object is to provide a portable baby changer that is collapsible and easy to carry when not in use.

An additional object is to provide a portable baby changer that is economical in cost.

A further object is to provide a portable baby changer that is easy to use.

A still further object is to provide a portable baby changer that can hook onto a sink or the back of a car seat.

Further objects of the invention will appear as the description proceeds.

DESCRIPTION OF THE DRAWINGS

FIG. 1 is a perspective view of the invention on a sink.

FIG. 2 is an end view taken along line 2—2 in FIG. 1.

FIG. 3 is a cross sectional view taken along line 3—3 in FIG. 2.

FIG. 4 is a front view of the frame in an open position.

FIG. 5 is a front view of the frame in a closed position.

FIG. 6 is an enlarged cross sectional view of part of the pad.

FIG. 7 is a perspective view of another embodiment of the invention on the back of a car seat.

DESCRIPTION OF THE PREFERRED EMBODIMENTS

Turning now descriptively to the drawings, in which similar reference characters denote similar elements throughout the several views, FIGS. 1 through 5 illustrates a portable baby changer 10 for changing a baby's diaper when needed. The portable baby changer 10 as shown in FIG. 1 consists of a collapsible frame 18 that engages a front lip of a sink 12 on a wall 11. A pair of adjustable hook straps 23*a* and 23*b* engages the frame 18 and the faucets of the sink 12. Each hook strap 23*a* and 23*b* is an elastic member having a hook affixed to each end. A container 16 is supported by the frame 18 and a pad 42 is placed within the container 16 so that a baby 14 can be put within the container 16 and have its diaper changed.

The pad 42, as best seen in FIG. 6, has an inner stiff plate 44 and a foam rubber coating 46 affixed around the inner stiff plate 44 to cushion the baby 14. A waterproof material cover 48 is affixed around the foam rubber coating 46 to keep the foam rubber coating 46 dry.

The frame 18 has two vertical portions 22*a* and 22*b*. Vertical portion 22*a* has a hook portion 24*a* at the top and an outwardly horizontal portion 26*a* at the bottom terminating with a bend end 28*a*. Vertical portion 22*b* has a hook portion 24*b* at the top and an outwardly horizontal portion 26*b* at the bottom terminating with a bent end 28*b*. A top brace 30 and a bottom brace 36 is placed between the vertical portions 22*a* and 22*b*. The top brace 30 has pivot pins 32 and 34. The bottom brace has pivot pins 38 and 40. The pivot pins 32 and 38 are in the vertical portion 22*a* and the pivot pins 34 and 40 are in the vertical portion 22*b* so that the entire frame 18 can be collapsible as shown in FIG. 5. Two end caps 50 are each placed on bent ends 28*a* and 28*b*.

The container 16 has loops 20*a* and 20*b* on the bottom that each engage horizontal portions 26*a* and 26*b* of the frame 18 so that the container 16 is supported by the frame 18. The container 16 is a basket made of flexible material and when the basket is not used it can be folded up and placed into a diaper bag.

FIG. 7 shows another embodiment of the invention. The portable baby changer 10' has a container in the form of a hammock 52 instead of a basket 16. The frame 18' has two vertical portions 22*a* and 22*b*. Vertical portion 22*a* has a hook portion 24*a* at the top, a sidewardly horizontal portion 26'*a* at the bottom, a vertical bent end 28'*a* terminating with an outwardly horizontal hook arm 29*a*. Vertical portion 22*b* has a hook portion 24*b* at the top, a sidewardly horizontal portion 26'*b* at the bottom, a vertical bent end 28'*b* terminating with an outwardly horizontal hook arm 29*b*. A top brace 30 and a bottom brace 36 is placed between the vertical portions 22*a* and 22*b*. The top brace 30 has pivot pins 32 and 34. The bottom brace has pivot pins 38 and 40. The pivot pins 32 and 38 are in the vertical portion 22*a* and the pivot pins 34 and 40 are in the vertical portion 22*b* so that the entire frame 18' can be collapsible. Two end caps 50 are each placed on the outwardly horizontal hook arms 29*a* and 29*b*.

The hammock 52 has loops 54 and 56 on each end so that they can engage the outwardly horizontal hook arms 29*a* and 29*b* of the frame 18' so that the hammock 52 is supported by the frame 18'. The frame 18' is shown on the back 13 of a car seat. It can also be placed on a sink 12 as in FIG. 1.

The basket 16 and hammock 52 can be made out of waterproof material such as vinyl or cloth. The frames 18 and 18' can be madeout of plastic or metal. The caps 50 can be made out of plastic or rubber.

While the form of apparatus herein described constitutes preferred embodiment of the invention, it is understood that the invention is not limited to this precise form of apparatus and that changes may be made therein without departing from the scope of this invention.

Having regard to the foregoing disclosure the following is claimed as the inventive and patentable embodiments thereof:

1. A portable baby changer which comprises:

(a) a collapsible frame that engages a front lip of a sink;

(b) an adjustable hook strap having an elastic member having having a hook affixed to each end of said elastic member that engages said collapible frame and one faucet of a sink;

(c) a container that is supported by said frame said container having the shape of a basket and constructed of flexible material having a pair of loops under said basket that engages said frame and when said basket is not used it can be folded up and placed into a diaper bag; and (d) a pad having an inner stiff plate, a foam rubber coating affixed around said inner stiff plate to cushion a baby and a waterproof material cover affixed around said foam rubber coating to keep said foam rubber coating dry, said pad placed within said container so that a baby can be put within said container and have its diaper changed.

* * * * *